US005347935A

United States Patent [19]

Whitaker

[11] Patent Number: 5,347,935

[45] Date of Patent: Sep. 20, 1994

[54] YARD TRASH BURNER

[76] Inventor: William W. Whitaker, 1705 Michigan Dr., Evansdale, Iowa 50707

[21] Appl. No.: 40,269

[22] Filed: Mar. 30, 1993

[51] Int. Cl.[5] ..... F23D 3/00; F23G 5/00

[52] U.S. Cl. ..... 110/240; 110/241; 126/224

[58] Field of Search ..... 110/235, 240, 241, 242, 110/243, 248, 251; 126/224

[56] References Cited

U.S. PATENT DOCUMENTS

| | | | |
|---|---|---|---|
| 264,920 | 9/1882 | Bell | 126/224 |
| 435,184 | 8/1890 | Mansen | 126/224 |
| 704,359 | 7/1902 | McGurrin | 126/224 |
| 1,545,497 | 7/1925 | Kener, Jr. | 126/224 |
| 1,871,614 | 8/1932 | Johnston . | |
| 1,955,641 | 4/1934 | Lane | 110/18 |
| 1,970,727 | 8/1934 | Bates | 110/19 |
| 2,737,911 | 3/1956 | Mims | 110/240 |
| 2,952,226 | 9/1960 | Sherman | 110/240 |
| 3,330,232 | 7/1967 | Wagle | 110/18 |
| 3,498,240 | 3/1970 | Trott | 126/224 |
| 4,688,494 | 8/1987 | Domnitch | 110/240 |
| 5,195,501 | 3/1993 | Ault | 110/241 |

*Primary Examiner*—Henry C. Yuen

*Attorney, Agent, or Firm*—Jacobson, Price, Holman & Stern

[57] ABSTRACT

A yard trash burner capable of effectively burning leaves, branches and other yard waste while preventing flying sparks and ashes that can create a fire hazard. The burner includes a wheeled frame with a handle structure to enable it to be easily moved to a desired position alongside of material to be burned. The burner includes an external barrel rigidly affixed to the wheeled frame and provided with a removable inner burner spaced concentrically from the barrel and being constructed of perforated metal or screen material. The inner burner has open ends with the top end having an inverted channel shaped cover welded thereto which is rigidly affixed to the barrel in spaced relation to enable air to enter the space between the inner burner and barrel to feed air though the openings in the inner burner at any elevation. The cover includes a perforated plate forming a spark arrester, grate and filter and a structure to facilitate moving and retaining the plate in open inclined position in order to load material into the inner burner. This structure enables combustion supporting air to move down between the outer barrel and perforated inner burner to supply combustion supporting air to the trash being burned at any elevation in the perforated inner burner.

16 Claims, 2 Drawing Sheets

FIG. 2
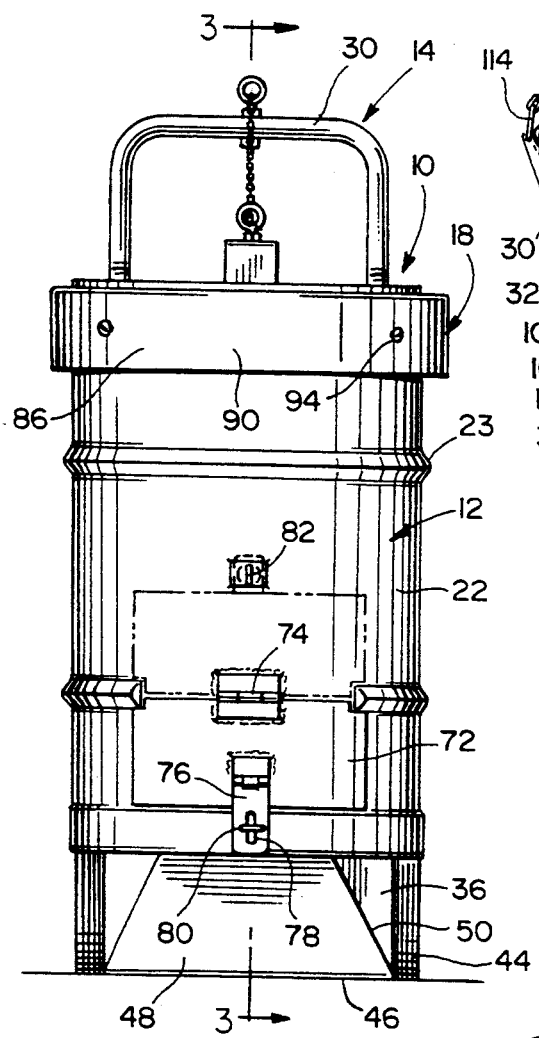
FIG. 3
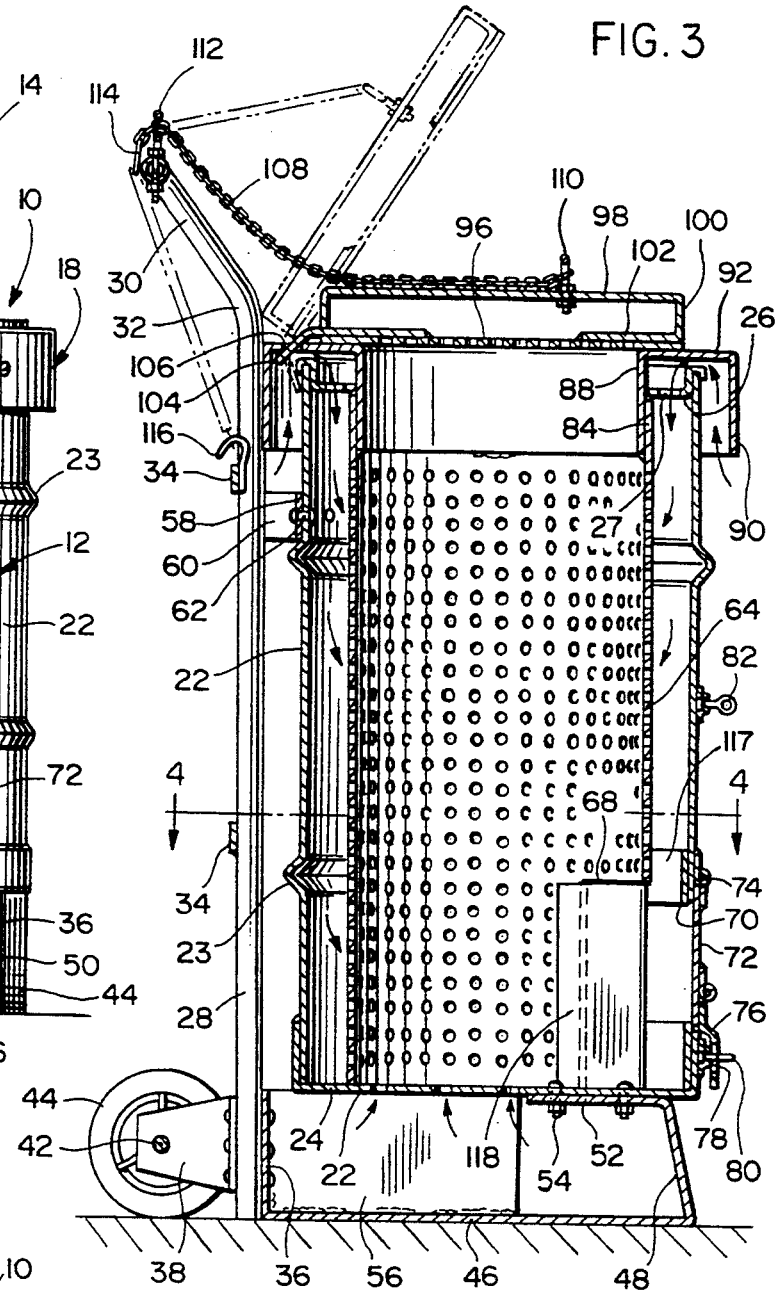
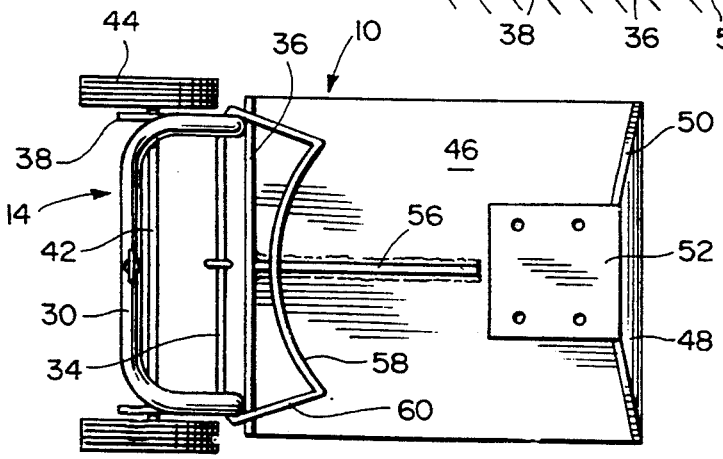
FIG. 7

YARD TRASH BURNER

BACKGROUND OF THE INVENTION

1. Field of the Invention

The present invention relates to a yard trash burner capable of effectively burning leaves, branches and other yard waste while preventing flying sparks and ashes that can create a fire hazard. The burner includes a wheeled frame with a handle structure to enable it to be easily moved to a desired position alongside of material to be burned. The burner includes a perforated top plate which serves as a spark arrester and also removes objectionable particulates which would be discharged into the atmosphere if an open fire was used to burn yard trash. The burner includes an external barrel rigidly affixed to the wheeled frame and provided with a removable inner burner spaced concentrically from the barrel and being constructed of perforated metal or screen material. The inner burner has open ends with the top end having an inverted channel shaped annular cover welded thereto which is rigidly affixed to the barrel in spaced relation to enable air to enter the space between the inner burner and barrel to feed air though the openings in the inner burner at any elevation. The cover includes a perforated plate forming a spark arrester, grate and filter and a structure to facilitate moving and retaining the plate in open position in order to load material into the inner burner. This structure enables combustion supporting air to move down between the outer barrel and perforated inner burner to supply combustion supporting air to the trash being burned at any elevation in the perforated inner burner.

2. Description of the Prior Art

Various types of burners and incinerators have been provided to enable individual homeowners to burn trash or refuse. Individual homeowners frequently resort to open burning either on the ground or in a barrel-like container which creates a fire hazard due to flying sparks, hot ashes and the like. In addition, many jurisdictions have enacted legislation or ordinances prohibiting open burning of trash due to the fire hazard and discharge of pollutants into the atmosphere. The following U.S. patents relate to this field of endeavor.

U.S. Pat. Nos.:

1,871,614
1,955,641
1,970,727
3,330,232
4,688,494

The above patents disclose various type of burners which basically include an enclosure to receive trash and enable combustion supporting air to enter the enclosure for the trash. The prior art does not disclose the specific structure of the disclosed invention including the arrangement of the outer barrel, wheeled frame and inner perforated burner to receive the trash being burned together with a perforated top plate serving as a spark arrester, grate and filter and a cover on the inner burner connected to the barrel in a manner to admit air into the space between the outer barrel and inner burner to support combustion at any elevation of trash in the inner burner.

SUMMARY OF THE INVENTION

An object of the present invention is to provide a yard trash burner which will effectively and safely burn leaves and other yard waste without introducing a fire hazard and without discharging excessive pollutants into the atmosphere as compared to open fire burning.

Another object of the invention is to provide a yard trash burner in accordance with the preceding objects which is provided with a wheeled frame and a handle structure to enable the burner to be easily moved to a desired location closely adjacent the trash to be burned, such as a pile of leaves, thereby eliminating the necessity of moving the trash to be burned to the location of the trash burner.

A further object of the invention is to provide a yard trash burner in accordance with the preceding objects in which the top of the burner includes a perforated plate forming a filter and functions as a grate and spark arrester for reducing the discharge of pollutants into the atmosphere and enables trash to be placed in the burner when pivoted to an open position.

Still another object of the invention is to provide a yard trash burner in accordance with the preceding objects including an outer barrel having a closed bottom and an inner burner of perforated metal or screen spaced concentrically from the outer barrel with air inlets in the bottom of the barrel and an inlet between the upper end of the barrel and cover to enable combustion supporting air to enter the space between the outer barrel and inner burner to support combustion of trash at any elevation along the height of the inner burner.

A still further object of the invention is to provide a trash burner which is simple in construction, effective in preventing flying sparks from creating a fire hazard, effective in reducing pollutants discharged into the atmosphere, safe and economical to manufacture and use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a front elevational view of the burner.

FIG. 3 is a vertical sectional view taken along section line 3—3 on FIG. 2 illustrating the structural features of the above invention.

FIG. 7 is a bottom plan view of the yard burner.

DESCRIPTION OF THE PREFERRED EMBODIMENT

Figure 1:
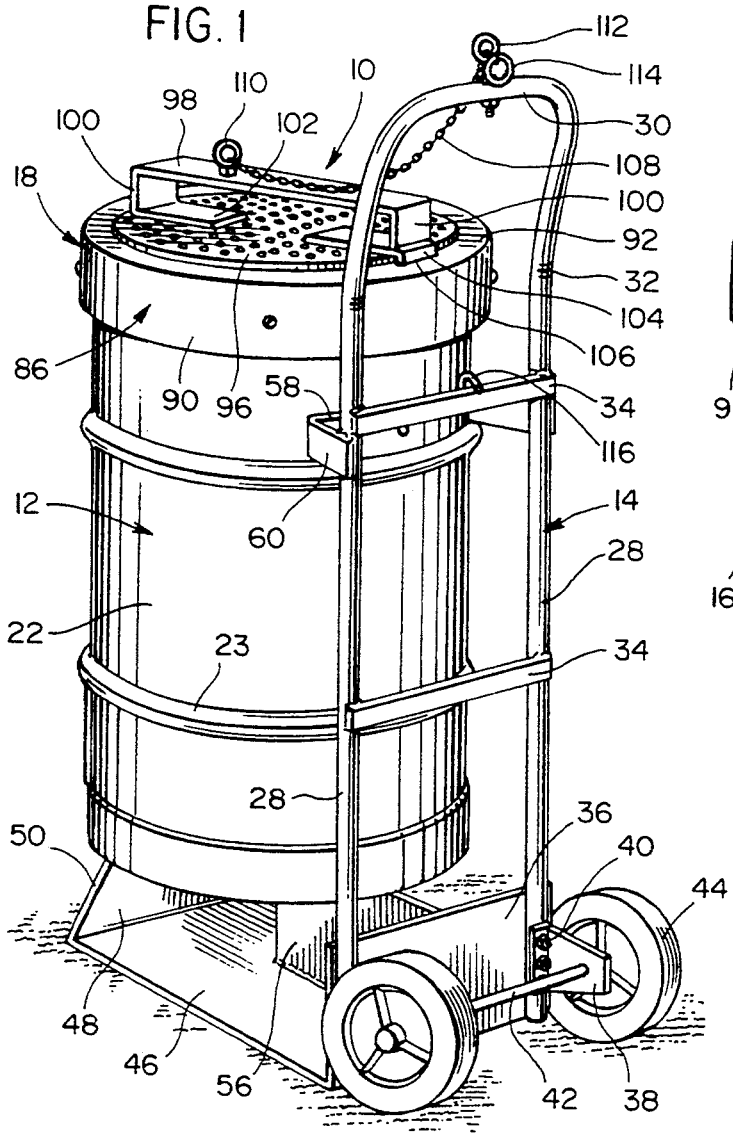
FIG. 1 is a perspective view of the yard trash burner of the present invention.

The yard trash burner of the present invention is generally designated by reference numeral 10 and includes an outer barrel generally designated by reference numeral 12, a wheeled frame generally designated by reference numeral 14 to support the burner 10, an inner burner generally designated by reference numeral 16 positioned within the outer barrel 12 in concentrically spaced relation and a top assembly generally designated by reference numeral 18 mounted at the open upper end of the outer barrel 12 and inner burner 16 in a manner described in detail hereinafter.

The outer barrel 12 includes a cylindrical barrel 22 of metal or the like having a bottom 24 with air inlet openings 25 formed therein. The barrel 22 may be a discarded cylindrical metal barrel which initially received liquid or other materials which were dispensed from the barrel with the barrel then being normally destroyed or in some instances recycled. The barrel 22 includes a narrow peripheral flange 26 forming an open upper end 27. The barrel 22 may be of any suitable height or diameter, may have peripheral reinforcing ribs 23 and may have cross sectional configurations other than cylindrical.

The wheeled frame 14 which supports the outer barrel 12 is generally in the form of hand truck and includes a pair of side rails 28 interconnected at their upper ends by a transverse member 30 forming a handle which is slightly offset to the rear by offset areas 32. The rails 28 are also interconnected by vertically spaced braces 34 and the lower ends of the rails 28 are interconnected by a plate 36 to maintain rigidity of the frame. The lower ends of the rails include brackets 38 secured in place by bolts 40 which also secure the plate 36 in place with the brackets 38 receiving an axle 42 with a wheel 44 mounted on the outer ends thereof with the wheels being outwardly of the brackets 38. The structure of the frame basically is that of a well known hand truck which, in this instance, is provided with an enlarged, laterally extending bottom plate 46 which forms a continuation of the plate 36 and is disposed in underlying spaced relation to the barrel 22. The outer end of the plate 46 is provided with an upwardly extending, slightly inclined plate 48 having upwardly converging side edges 50 terminating in an inwardly extending horizontally disposed rectangular plate 52 which underlies the outer end of the bottom 24 of the barrel and is secured thereto by bolts 54 as illustrated in FIG. 3. Also, a vertically disposed reinforcing and supporting plate 56 is affixed centrally to the upper surface of the plate 46 and also to the center of the plate 36 and extends outwardly so that the other end supports the bottom 24 of the barrel 22 as illustrated in FIGS. 1, 3 and 7. The supporting frame 14 is also provided with an arcuate curved strap 58 adjacent the upper transverse brace 34 which has laterally extending ends 60 welded to the frame rails 28 with the arcuate portion of the bracket 58 conforming with and engaging the periphery of the barrel 22 and being secured thereto by fastening devices such as rivets or bolts 62 thus rigidly mounting and connecting the barrel and supporting frame with the wheeled construction of the supporting frame enabling the yard trash burner 10 to be easily moved to a position adjacent to the material to be burned.

Figure 5:
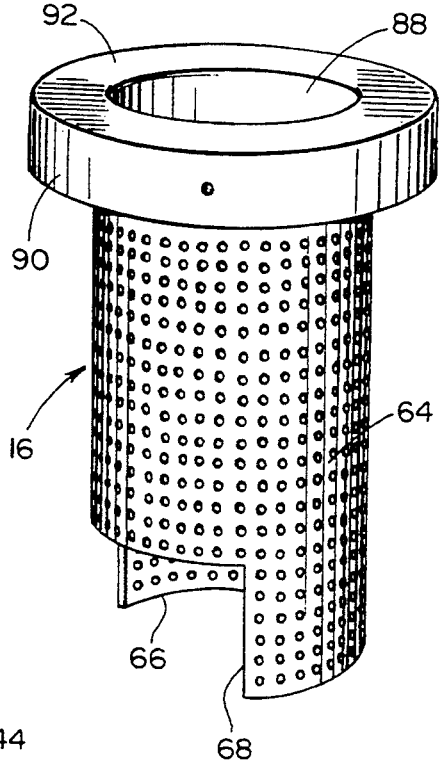
FIG. 5 is a perspective view of the inner burner.

The inner burner 16 includes a cylindrical perforated metal member or metal screen member 64 oriented in concentric spaced relation to the barrel 22. The cylindrical member 64 includes an open bottom 66 and a portion of the periphery of the bottom end of the cylindrical member 64 is removed to form a recess or opening 68 extending upwardly from the bottom 66 of the cylindrical member 64 as illustrated in FIG. 5. As illustrated in FIG. 3, the recess or opening 68 is in alignment with an opening 70 in the barrel 22 which is in the front lower end of the barrel in remote relation to the supporting frame 14 as illustrated in FIGS. 2 and 3. The opening 70 includes an arcuate closure door 72 hinged at its top edge to the barrel 22 at the top edge of the opening 70 by a hinge structure 74. The bottom edge of the door 72 is provided with a pivotal hasp 76 having a slot 78 therein which receives a twist lock 80 mounted on the lower end of the barrel 22 to retain the door in closed position. The barrel 22 is also provided with a twist lock 82 spaced above the hinge 74 to receive the hasp 76 when the door is opened thereby retaining the door 72 in open position to provide access into the lower end of the barrel 22 and into the lower end of the inner burner 16 to provide access to ashes or other residue at the lower end of the inner burner 16 as may be necessary as the burner 10 is used.

Figure 6:
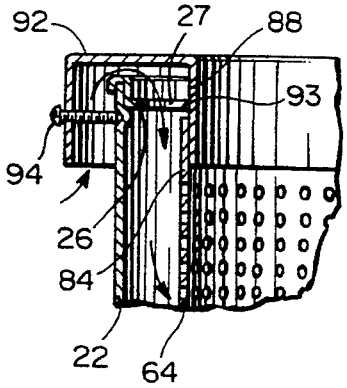
FIG. 6 is a detailed sectional view of the upper end of the yard burner illustrating the air inlet.

The upper end of the cylindrical perforated member includes an imperforate portion 84 to which a portion of the top assembly 18 is attached. The top assembly includes an inverted annular cover generally designated by reference numeral 86 and which is of inverted channel shaped configuration and includes an inner flange 88 of cylindrical configuration, an outer flange 90 of the same configuration and spaced concentrically therefrom with the flanges 88 and 90 being interconnected by a top member 92. As illustrated in FIGS. 3 and 6, the inner flange 88 is welded to the upper end portion 84 of the cylindrical member 64 which forms the inner burner 16. The outer flange 90 includes a plurality of bolts or set screws 94 which are threaded therethrough with the inner ends of the bolts or set screws 94 clampingly engaging the upper end portion of the barrel 22 as illustrated in FIGS. 3 and 6 thus rigidly affixing the cover 86 to the upper end of the barrel but enabling removal of the cover when desired. By loosening the bolts or set screws 94, the cover 86 and the inner burner 16 can be lifted upwardly from the barrel 22 to enable disassembly of the device when necessary and facilitating complete cleaning of the interior of the barrel and inner burner when necessary.

As illustrated in FIG. 6, the top member 92 is supported by the bolts or set screws 94 in vertically spaced relation to the top edge of the barrel 22. Likewise, the inner edge of the flange 26 designated by reference numeral 93 is spaced from the periphery of the inner flange 88 and the periphery of the imperforate portion 84 of the cylindrical member 64 thereby providing an air inlet passageway or space to enable combustion supporting air to enter through the space between the bottom edge of the outer flange 90 and the barrel 22, pass over the top edge of the barrel 22 where it is spaced from the top member 92 and pass downwardly through the inner edge 93 of the flange 26 and downwardly between the barrel 22 and the cylindrical member 64 to supply combustion supporting air through the apertures in the cylindrical member 64 to the trash therein to be burned at any elevation. In instances where the barrel 22 does not include a flange 26 the operation of the device is exactly the same with it only being necessary that the top member 92 be spaced above the barrel 22 and the outer flange 90 and the inner flange 88 be spaced concentrically from the barrel 22.

The annular cover 86 is provided with a perforated plate 96 of circular configuration which forms a closure for the upper end of the inner burner 16 with the perforations permitting discharge of smoke with the perforated plate also serving as a grate and spark arrester with the perforations reducing the discharge of sparks, flying ashes or other particulates thus reducing pollution discharged into the atmosphere. The plate 96 rests on the top member 92 of the cover 86 and can be pivoted to an open position. This function is accomplished by a strap or bar 98 supported in spaced relation from the plate 96 by downturned end flanges 100 and inturned flanges 102 which are welded to opposite edge portions of the plate 96. Attached to and forming an extension of one of the inturn flanges 102 is an outwardly extending and downwardly inclined lug or projection 104 that is loosely received in a slot 106 in the top member 92 of cover 86 as illustrated in FIGS. 1 and 3. This structure forms a pivot point for the plate 96 to enable it to move from a closed position to an upwardly inclined position as illustrated in broken lines in FIG. 3 to facilitate placement of trash material into the inner burner 16.

To retain the plate 96 in the open position, a flexible chain 108 is provided which has one end anchored to an eye or loop 110 affixed to the bar 98 adjacent the end thereof remote from the lug or projection 104 as illustrated in FIG. 3. The other end of the chain extends through a guide eye or loop 112 mounted on the central portion of the handle 30 with the terminal end of the chain including a ring 114 by which the chain can be grasped and pulled with the ring 114 then being positioned over a downwardly opening hook 116 attached centrally to the upper transverse brace 34 to thus hold the perforated plate 96 in the upwardly inclined open position as illustrated in FIG. 3. The pull chain 108 and the loop or eye 112 and the ring 114 enables the chain to be locked to the hook 116 to keep the perforated plate in open position while the burner is being filled with trash to be burned. This allows the inner burner to be filled without danger of burning the fingers since the loop or ring 114 on the chain will remain cool as will the handle 30 due to the spaced relation from the barrel and perforated plate 96 which forms a closure for the inner burner and also forms a grate, spark arrester and filter.

Figure 4:
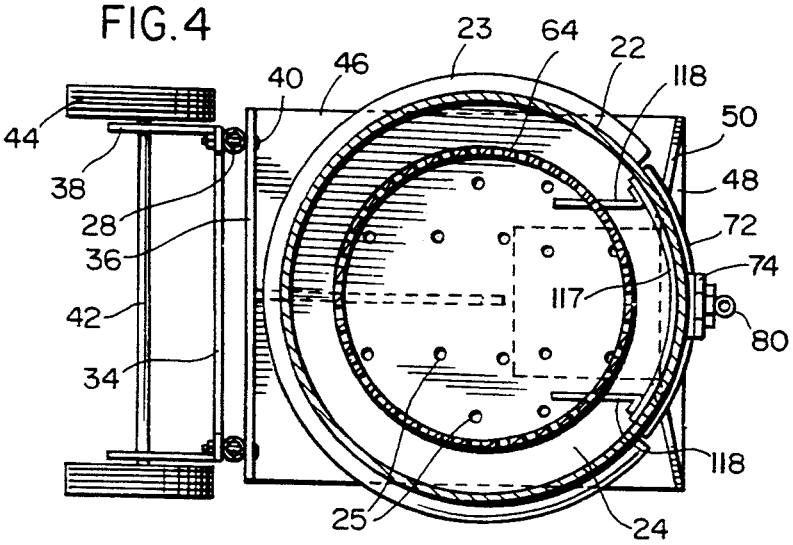
FIG. 4 is a transverse sectional view taken along section line 4—4 on FIG. 3 illustrating further structural details of the burner.

As illustrated in FIGS. 3 and 4, the opening 70 includes a peripheral reinforcement 117 and a pair of inwardly extending plates 118 which are generally parallel to each other as illustrated in FIG. 4 and enter the notch 68 and are positioned along the vertical edges of the notch 68 to locate the notch 68 in alignment with the opening 70 and to guide an ash removal shovel or the like and also provide an entrance space for combustion supporting air in the event the door 72 is open to provide additional draft for combustion supporting air.

The arrows illustrated in FIG. 3 and FIG. 6 indicate the air movement into the yard burner. As waste or ashes accumulate from the bottom of the inner burner, air will initially enter through the openings 25 as well as through the openings in the inner burner and through the notch 68 and through the opening 70 if the door 72 is open. The hot products of combustion will exit upwardly through the perforated plate 96 and as the ashes build up in the inner burner, air will continue to enter through the perforated member 64 at any elevation at which combustion occurs. Ashes can be removed through the door 72 and after the burner has been used, it can be permitted to cool and completely cleaned by removing the inner burner and washing all components with a hose. This yard burner effectively enables leaves and other waste to be burned without creating a fire hazard and reducing pollution that would occur from open fire burning. The burner can be easily moved to a location adjacent the material to be burned thus reducing the necessity of raking leaves to the burner or carrying trash to the site of the burner. The burner can be used as an outdoor grill and can be used to heat unheated outbuildings or the like and also provides a significantly beneficial use for barrels that are frequently discarded.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A trash burner comprising a barrel defined by a peripheral wall disposed generally vertically and including an upper end having an open area, a perforated inner burner defined by a peripheral perforated wall disposed within said barrel in spaced relation to the peripheral wall, said perforated inner burner having an upper end with an upwardly facing opening to receive trash to be burned and discharge combustion products, means interconnecting the upper end of the inner burner with the upper end of the barrel to position the inner burner in the barrel and admit combustion supporting air downwardly between the peripheral wall of the barrel and the peripheral wall of the inner burner to supply combustion supporting air to trash being burned in the inner burner and a perforated plate forming a spark arrester and a closure for the upper end of the burner to prevent egress of sparks into the atmosphere.

2. The burner as defined in claim 1 together with wheeled support means connected to said barrel adjacent the lower end thereof, and handle means connected to said wheeled support means and disposed above the upper end of said barrel by which said trash burner can be moved to a site adjacent trash to be burned.

3. The burner as defined in claim 2 wherein said wheeled support means includes a generally vertically disposed frame rigidly secured to said barrel with one end of the frame projecting laterally under the lower end of the barrel, a pair of wheels journaled from said frame with the wheels being in spaced relation to the barrel to space the wheels from hot surface area formed when trash is burned and a support structure attached to the frame in spaced relation to the wheels to provide a stable support for the barrel.

4. The burner as defined in claim 3 wherein said means interconnecting the upper end of the barrel and the upper end of the inner burner includes an annular cover rigidly connected to an upper end of said inner burner, said cover being of generally channel shaped configuration with an inner flange connected to said inner burner and an outer flange spaced concentrically from the inner flange and a top member interconnecting said flanges, means on said outer flange engaging the upper end of said barrel to support the top member of the cover in spaced relation to the upper end of the barrel to provide a passageway for combustion supporting air upwardly between the outer flange and the upper end of the barrel, inwardly between the upper edge of the barrel and the top member of the cover and downwardly between the barrel and the upper end of the inner burner to supply air to the space between the inner burner and the barrel to support combustion at any elevation within the inner burner.

5. A trash burner comprising a barrel defined by a peripheral wall disposed generally vertically and including an upper end having an open area, a perforated inner burner defined by a peripheral perforated wall disposed within said barrel in spaced relation to the peripheral wall, said perforated inner burner having an upper end with an upwardly facing opening to receive trash to be burned and discharge combustion products, means interconnecting the upper end of the inner burner with the upper end of the barrel to position the inner burner in the barrel and admit combustion supporting air downwardly between the peripheral wall of the barrel and the peripheral wall of the inner burner to supply combustion supporting air to trash being burned in the inner burner and a perforated plate forming a spark arrester and a closure for the upper end of the burner to prevent egress of sparks into the atmosphere, wheeled support means connected to said barrel adjacent the lower end thereof, and handle means connected to said wheeled support means and disposed above the upper end of said barrel by which said trash burner can be moved to a site adjacent trash to be burned, said wheeled support means including a generally vertically disposed frame rigidly secured to said barrel with one end of the frame projecting laterally under the lower end of the barrel, a pair of wheels journaled from said frame with the wheels being in spaced relation to the barrel to space the wheels from hot surface area formed when trash is burned and a support structure attached to the frame in spaced relation to the wheels to provide a stable support for the barrel, said means interconnecting the upper end of the barrel and the upper end of the inner burner including an annular cover rigidly connected to an upper end of said burner, said cover being of generally channel shaped configuration with an inner flange connected to said inner burner and an outer flange spaced concentrically from the inner flange and a top member interconnecting said flanges, means on said outer flange engaging the upper end of said barrel to support the top member of the cover in spaced relation to the upper end of the barrel to provide a passageway for combustion supporting air upwardly between the outer flange and the upper end of the barrel, inwardly between the upper edge of the barrel and the top member of the cover and downwardly between the barrel and the upper end of the inner burner to supply air to the space between the inner burner and the barrel to support combustion at any elevation within the inner burner, said perforated plate forming a closure for said annular cover with the perforated plate resting on the top member of said cover, means connecting an edge portion of said perforated plate to an outer portion of said top member of the cover to enable removal of the perforated plate and pivotal movement of the perforated plate from a closed position to an upwardly inclined open position, and means retaining the perforated plate releasably in its open position.

6. The burner as defined in claim 5 wherein said means supporting the perforated plate from the cover includes a laterally extending and downwardly inclined lug on the periphery of said perforated plate, the top member of said cover including a slot adjacent the outer flange thereof receiving said lug and retaining the peripheral edge of the perforated plate adjacent the slot in the cover when the opposite edge portion of the perforated plate is lifted upwardly and arcuately into an inclined position.

7. The burner as defined in claim 6 wherein said means to releasably retain the perforated plate in open position includes a flexible member having one end attached to the perforated plate adjacent the edge thereof opposite from the lug, said handle means including a guide for the flexible member and means on said frame to detachable connect the end of the flexible member thereto when the flexible member has been pulled to elevate the edge of the perforated plate remote from the projection upwardly to an inclined position.

8. The burner as defined in claim 7 wherein said frame includes a pair of generally parallel rails, said handle means including a transverse member interconnecting the upper ends of the rails with the handle member spaced above the perforated plate.

9. The burner as defined in claim 8 wherein said support structure includes a bottom plate extending from the side rails in opposed relation to the wheels, said bottom plate terminating in an upwardly extending front plate having an inturned top edge portion underlying and in attached supporting relation to said barrel.

10. The burner as defined in claim 5 wherein said inner burner includes an open bottom having a notch formed in an edge portion thereof and communicating with the bottom end of the inner burner, said barrel including an opening adjacent the bottom end thereof with the opening being aligned with the notch in the inner burner, a closure door for the opening, means supporting the closure door for movement between a closed position and an open position to enable access into the interior of the barrel and the interior of the inner burner.

11. The burner as defined in claim 10 wherein said opening in the barrel includes a pair of generally parallel inwardly extending plates extending into the interior of the inner burner through the notch formed in the lower end thereof.

12. A yard trash burner comprising an external metal barrel, a wheeled frame rigidly connected to said barrel to support the barrel generally in vertically disposed relation, a handle at the upper end of the frame by which the burner can be moved to a desired location, an internal cylindrical burner receiving trash, said internal burner being constructed of metal having openings extending therethrough throughout its vertical height to enable passage of combustion supporting air, said internal burner within the barrel being spaced concentrically from the barrel to enable access of combustion supporting air throughout the vertical height of the internal burner within the barrel, means at the upper end of the burner to discharge combustion products and means at the upper end of the barrel admitting combustion supporting air downwardly between the barrel and the internal burner.

13. A material burner comprising a generally vertically disposed receptacle defined by a peripheral wall having a bottom and an open top, an inner perforated peripheral wall disposed within said receptacle in spaced relation, said inner perforated wall having an open upper end to receive material to be burned and to discharge combustion products, means connecting the upper end of the inner perforated wall with the open top of the receptacle to position the inner perforated wall in spaced relation to the peripheral wall defining the receptacle, said means including means defining passageways for movement of combustion supporting air downwardly between the peripheral wall of the receptacle and the inner perforated peripheral wall to supply combustion supporting air to material being burned in the inner perforated wall substantially throughout the length of the inner perforated wall, and a perforated closure plate for the open upper end of the inner perforated wall to enable discharge of combustion products and forming a spark arrester to reduce discharge of sparks into the atmosphere.

14. The burner as defined in claim 13 wherein said means connecting the upper end of the inner peripheral wall with the open top of the peripheral wall forming the receptacle includes a peripheral flange extending outwardly from the upper end of the inner peripheral wall and supportingly engaging the open top of the peripheral wall forming the receptacle with said flange spacing the inner peripheral wall from the peripheral wall of the receptacle, said flange including apertures extending therethrough defining said passageways for combustion supporting air to pass downwardly between the peripheral wall of the receptacle and the inner perforated wall.

15. The burner as defined in claim 14 wherein said inner perforated wall includes an annular, downwardly facing channel shaped member having an inner flange affixed to the upper end of the inner peripheral wall, a top flange extending radially outwardly above the upper end of the peripheral wall defining the receptacle and a downwardly extending flange concentrically spaced from the outer surface of an upper end portion of the peripheral wall defining the receptacle thereby forming an annular downwardly opening space for admitting combustion supporting air upwardly between the outer flange and the outer surface of the upper end portion of the peripheral wall defining the receptacle and inwardly between the top flange and an upper edge of the peripheral wall defining the receptacle and downwardly through the apertures in the flange interconnecting the upper end of the inner perforated wall and the upper end portion of the peripheral wall defining the receptacle.

16. The burner as defined in claim 15 wherein said perforated plate is supported from said annular member, means connecting an edge portion of the perforated plate to the top flange of said annular member to enable the perforated plate to pivot between a closed position and upwardly inclined open position, and an elongated flexible member connected to said perforated plate to move the perforated plate from a closed to open position from a point remote from the perforated plate to enable the perforate plate to be opened without hand contact with the plate.

* * * * *